US009012121B2

(12) United States Patent
Zhu et al.

(10) Patent No.: US 9,012,121 B2
(45) Date of Patent: Apr. 21, 2015

(54) COLORED TONER AND METHOD FOR PREPARING THE SAME

(71) Applicant: Hubei Dinglong Chemical Co., Ltd., Wuhan (CN)

(72) Inventors: Shunquan Zhu, Wuhan (CN); Guilin Xiao, Wuhan (CN)

(73) Assignee: Hubei Dinglong Chemical Co., Ltd., Wuhan (CN)

( * ) Notice: Subject to any disclaimer, the term of this patent is extended or adjusted under 35 U.S.C. 154(b) by 29 days.

(21) Appl. No.: 13/845,153

(22) Filed: Mar. 18, 2013

(65) Prior Publication Data

US 2013/0344426 A1 Dec. 26, 2013

(30) Foreign Application Priority Data

Jun. 20, 2012 (CN) ..... 2012 1 0204474

(51) Int. Cl.

| | |
|---|---|
| ***G03G 9/08*** | (2006.01) |
| ***G03G 9/087*** | (2006.01) |
| ***G03G 9/09*** | (2006.01) |

(52) U.S. Cl.

CPC ..... *G03G 9/0812* (2013.01); *G03G 9/0804* (2013.01); *G03G 9/08782* (2013.01); *G03G 9/08786* (2013.01); *G03G 9/09* (2013.01); *G03G 9/0904* (2013.01); *G03G 9/0924* (2013.01); *G03G 9/0926* (2013.01)

(58) Field of Classification Search

CPC ..... G03G 9/0804
USPC ..... 430/137.14
See application file for complete search history.

(56) References Cited

U.S. PATENT DOCUMENTS

2010/0167197 A1 * 7/2010 Yuasa et al. ..... 430/137.14

* cited by examiner

*Primary Examiner* — Mark A Chapman
(74) *Attorney, Agent, or Firm* — Matthias Scholl P.C.; Matthias Scholl

(57) ABSTRACT

A method for preparing a colored toner. The method includes: 1) providing surface-treated colorant, polymerizing the colorant by atom transfer radical polymerization (ATRP) to produce polymer-grafted colorant particles and dispersing the colorant particles in an aqueous solution including a surfactant to yield a first emulsion; 2) providing surface-treated wax, polymerizing the wax by ATRP to produce polymer-grafted wax particles, and dispersing the wax particles in the aqueous solution including the surfactant to yield a second emulsion; and 3) agglutinating the first emulsion and the second emulsion.

18 Claims, No Drawings

COLORED TONER AND METHOD FOR PREPARING THE SAME

CROSS-REFERENCE TO RELATED APPLICATIONS

Pursuant to 35 U.S.C. §119 and the Paris Convention Treaty, this application claims the benefit of Chinese Patent Application No. 201210204474.9 filed Jun. 20, 2012, the contents of which are incorporated herein by reference. Inquiries from the public to applicants or assignees concerning this document or the related applications should be directed to: Matthias Scholl P. C., Attn.: Dr. Matthias Scholl Esq., 14781 Memorial Drive, Suite 1319, Houston, Tex. 77079.

BACKGROUND OF THE INVENTION

1. Field of the Invention

The invention is related to colored toner used for xerographic duplicators and printers and a preparation method thereof.

2. Description of the Related Art

Colored toner, mainly consisting of resin, pigment, and additive, is an important material for color laser printing and color digital copying. Conventional methods for preparing a colored toner involve melting and mixing a resin (mainly a copolymer of styrene-butyl acrylate), a colorant (a pigment or a dye), and an additive (a charge regulator or a release agent), grinding the mixture mechanically at low temperature, further grinding by gas flow, and grading to yield a colored toner with a particle size of about 10 μm. The methods have difficulty in uniformly dispersing the colorant in the resin, and the resultant toner particles are big and their size and shape are not uniform. Thus, upon printing or copying, the resolution is low, the color is poor, the rate of waste toner is high, and the colored toner is easy to stick to rollers. The suspension polymerization method developed by Canon Co., Ltd. can effectively control the particle size of colored toner, improve the flow and charging properties, enhance the fixation stability and consolidation properties, and inhibit print through. However, the resultant toner has a wide particle size distribution, and upon printing or copying, the resolution is low and the color is poor. In addition, the toner is too round in shape, which makes it very difficult to recycle and clean the residual toner on a photoreceptor.

The emulsion polymerization/co-flocculation method developed by Fuji Xerox and Konica-Minolta can narrow the particle size of colored toner to 5 μm or even a nano level by regulating a surfactant and shear rate and control the shape of colored toner by controlling flocculation and heat treatment, whereby improving the resolution and color of printing and copying. The resultant toner is non-spherical, which makes it easy to recycle and clean the residual toner on a photoreceptor. However, in the process of mixing, flocculating, and heating the polymer emulsion and the colorant emulsion, the resin particles and the colorant particles are hard to disperse uniformly and hard to bind to each other. On the other hand, to improve the anti-partial printing properties, a large amount of wax is required, which easily causes wax to transfer to the surface of toner to pollute the carrier and developing sleeve. Furthermore, excess wax causes the uneven distribution of pigment in the toner, whereby resulting in a poor quality of printing and copying.

SUMMARY OF THE INVENTION

In view of the above-described problems, it is one objective of the invention to provide a method for preparing a colored toner characterized by simple process, good reliability, stable performance, good developing density, high charge-mass ratio of toner, narrower distribution of charge-mass ratio of toner, low gray background and waste powder rates in printing, lower consumption and higher resolution.

To achieve the above objectives, in accordance with one embodiment of the invention, there is provided a method for preparing a colored toner. The method comprises: 1) providing surface-treated colorant as an initiating agent, polymerizing the colorant by atom transfer radical polymerization (ATRP) to produce polymer-grafted colorant particles, and dispersing the colorant particles in an aqueous solution comprising a surfactant to yield a first emulsion A; 2) providing surface-treated wax as an initiating agent, polymerizing the wax by ATRP to produce polymer-grafted wax particles, and dispersing the wax particles in the aqueous solution comprising the surfactant to yield a second emulsion B; and 3) agglutinating the first emulsion A and the second emulsion B.

In a class of this embodiment, during the agglutinating, a third emulsion C is added. The third emulsion C is a polymer emulsion produced by emulsion polymerization, with monomers as its materials. In the agglutination, the first emulsion A accounts for 10% to 60%, the second emulsion B accounts for 10% to 60% and the third emulsion C accounts for 0% to 80%; the total weight percent is 100%. In the process of the polymer modification of colorants and wax, the proportion of polymers and colorants or wax can be controlled reasonably. The more the polymerized monomers are used in the modification, the more the polymers are grafted on the surface of colorants or wax. Correspondingly, the amount of the third emulsion C used in the process of the agglutination is small or zero. In the colored toner, the optimum mass percent of the content of the colorant particles is 3% to 10% and that of the content of the wax is 3% to 15%. Hence, the technicians in this field can calculate and add the specific amount of the third emulsion C by referring to this method.

In a class of this embodiment, a mass percent of the colorant particles of the first emulsion A is 5% to 50%, particularly, 10% to 30%. A mass percent of the wax particles of the second emulsion B is 5% to 50%, particularly, 10% to 30%.

In a class of this embodiment, the surface-treated colorant is obtained by: 1) adding a colorant into a solvent, dispersing the colorant while dropwise adding a modifier for surface modification, and washing, filtering, and drying a modified product. The surface-treated wax is obtained by: 1) adding a wax into the solvent, dispersing the wax while dropwise adding the modifier for surface modification, and washing, filtering, and drying a modified product.

In a class of this embodiment, the solvent can be selected in accordance with the used colorant and wax. Preferably, the solvent is toluene, dichloromethane, tetrahydrofuran, or a mixture thereof, and the modifier is chloropropene acyl chloride, bromopropylene acyl rtomide, or a derivative thereof.

In a class of this embodiment, particle diameters of the first emulsion A and the second emulsion B are both between 100 nm and 500 nm and particularly between 150 nm and 300 nm. Excessively large particle diameter results in the light color and uneven distribution of wax. Excessively small particle diameter causes high dispersion cost, and the colorant and the wax cannot be coated evenly by polymers.

In another aspect, the invention provides a colored toner, which is produced by the preparation method.

Through elaborate research, the researchers of the invention apply modifiers to modify the surfaces of colorants and wax (that is the surface treatment), and then chemically connect the colorants with polymers and the wax with polymers by the ATRP method separately to efficiently improve the dispersity of the colorant and the wax in the toner. The polymers can be grafted to the surfaces of the colorant and the wax by the ATRP method Taking advantage of the key joint completely avoids the problem of the drop of the polymers coated by the physical method in the post usage process and also avoids the problem of the outleakage of the colorant and the wax into the surface of the toner, especially in the spheroidization period of the low temperature wax after the agglomeration, when use the ordinary emulsion polymerization to produce the chemical toner. It solves the problems of the unstable charge-mass ratio of toner, unstable distribution of charge-mass ratio of toner and bad printing effect caused by the out-leakage of the colorant and the wax existing in the preparation process of the chemical toner for a long time.

The atom transfer radical polymerization method (ATRP method) is described as follows: separately add surface-treated colorants, polymerized monomers, reaction catalysts into the solvent to disperse at a high speed, and then degas to conduct the ATRP reaction to produce the colorant particles graft-modified by polymers; meanwhile, separately add the surfaced-treated wax, polymerized monomers, reaction catalysts into the solvent to disperse at a high speed, and then degas to conduct the ATRP reaction to produce the wax particles graft-modified by polymers. In addition, in the ATRP method, the solvent can at least be one of N, N-dimethylformamide and its derivative, methanol, ethanol or straight chain alcohol and branch chain alcohol with the length of the carbon chain no more than 12. The reaction catalyst can be the complex formed by the transition metal compound and the nitrogenous compound or the phosphorus compound; the transition metal compound is the halides of Cu and Fe, sulfate, nitrate or acetate; the nitrogenous compound can be 2,2'-bipyridine and its derivative, N,N'-tetramethylethylenediamine and N, N',N"-PMDETA; the phosphorus compound is triphenylphosphine or tributyl phosphine. The additive amount of the polymerized monomer is 2 times to 9 times larger than the corresponding amount of the surface-treated colorant (or the surface-treated wax), and the additive amount of the reaction catalyst is 0.1% to 1% of the monomer quality. In the ATRP method, the used solvent can be methanol, ethanol and N, N-dimethylformamide.

In a class of this embodiment, the monomer is selected from styrene, α-methyl styrene, ethyl acrylate, n-butyl acrylate, isobutyl acrylate, tert-butyl acrylate, n-hexyl acrylate, 2-ethylhexyl acrylate, dodecyl acrylate, methyl methacrylate, ethyl methacrylate, n-butyl methacrylate, isobutyl methacrylate, tert-butyl methacrylate, n-hexyl methacrylate, 1,3-butadiene, or 1,2-butadiene, and particularly styrene or butyl acrylate. A polar monomer is acrylic acid, methacrylic acid, fumaric acid, maleic acid, crotonic acid, or itaconic acid, and particularly acrylic acid or methacrylic acid.

In a class of this embodiment, the wax is selected from a low molecular weight of polyethylene wax, maleic anhydride-modified polyethylene wax, low molecular weight of polypropylene wax, or low molecular weight of copolyolefin wax; a hydrocarbon wax, such as paraffin or microcrystalline wax; docosanoic acid docosyl ester; stearic acid stearyl; a natural wax, such as carnauba wax and beeswax; or a higher fatty acid amide, such as oleic acid amide and stearic amide.

In a class of this embodiment, the colorant is an inorganic pigment, an organic pigment, an organic dye, or a mixture thereof. For example, cyan colorants: pigment blue 15:3, pigment blue 15:4, etc.; yellow colorants: pigment yellow 74, pigment yellow 93, pigment yellow 94, pigment yellow 155, solvent yellow 162, pigment yellow 180, pigment yellow 185, etc.; magenta colorants: pigment red 31, pigment red 122, pigment red 150, pigment red 184, pigment red 185, pigment red 57:1, pigment red 238, pigment red 269 etc; black colorants: carbon black, magnetite, etc.

The surfactant of the invention can be anionic surfactant, cationic surfactant, non-ionic surfactant or their compound. As for the use amount of the surface active agent, the technicians in this field can prepare it by referring to the existing technology. The optimum amount is 5-20% of the quality of the dispersive materials (polymer-grafted colorant particles or polymer-grafted wax particles).

In a class of this embodiment, the cationic surfactant is an amine salt surfactant, a quaternary ammonium surfactant, or a mixture thereof. The amine salt surfactant is selected from the group consisting of a primary amine salt surfactant, secondary amine salt surfactant, tertiary amine salt surfactant, hydroxyl amine, diamine, polyamine, an amine derivative containing acyl, or a guanidine derivative containing acyl. The quaternary ammonium surfactant is selected from the group consisting of a dodecyl trimethyl ammonium chloride, cetyl trimethyl ammonium chloride, octadecyl trimethyl ammonium chloride, dodecyl dimethyl benzyl ammonium chloride, cetyl dimethyl benzyl ammonium chloride, octadecyl dimethyl benzyl ammonium chloride, dodecyl trimethyl ammonium bromide, cetyl trimethyl ammonium bromide, octadecyl trimethyl ammonium bromide, dodecyl dimethyl benzyl ammonium bromide, cetyl dimethyl benzyl ammonium bromide, octadecyl dimethyl benzyl ammonium bromide, cetyl dimethyl allyl ammonium chloride, N, N-dimethyl-N-benzyl-3-(stearylamino) propylamine chloride, and dibenzyl-di(stearamide ethyl) ammonium chloride. The quaternary ammonium surfactant is preferable, and alkyl dimethyl benzyl ammonium chloride is more preferable.

In a class of this embodiment, the anionic surfactant is a carboxylate, sulfonate, sulfate, a structure-mixed surfactant, or a mixture thereof, including but not limited to fatty alcohol polyoxyethylene ether carboxylale, sodium stearate, straight chain sodium alkylbenzene sulfonate, branched chain sodium alkylbenzene sulfonate, sodium diisopropyl naphthalene sulfonate, sodium dibutyl naphthalene sulfonate, sodium alkyl sulfonate, sodium α-olefin sulfonate, α-sulfo fatty acid ester, straight chain alkyl sulfate, sodium branched-chain alkyl sulfate, and fatty alcohol polyoxyethylene ether sulfate. Straight chain alkyl sulfate and fatty alcohol polyoxyethylene ether sulfate are preferable.

In a class of this embodiment, the nonionic surfactant is a fatty alcohol polyoxyethylene ether, alkylphenol polyoxyethylene ether, polyoxyethylene carboxylate, alkanolamide, or polyoxyethylene alkanolamide, particularly alkylphenol polyoxyethylene ether, and more particularly alkylphenol polyoxyethylene ether having between 8 and 10 carbon atoms.

A flocculant is added as needed during the agglutination of the toner of the invention. The flocculant comprises various inorganic salts with flocculation such as sodium chloride, sodium sulfate, sodium nitrate, magnesium chloride, magnesium sulfate, magnesium nitrate, aluminum sulfate, polymeric chloride, sodium hexametaphosphate and sodium phosphate. The flocculant can be one of them or a compound of some of them.

Advantages of the invention are summarized below: the method is characterized by simple process and high reliability and chemically connects the colorant with polymers and wax with polymers respectively by the ATRP method which efficiently improves the dispersibility of the colorant and the wax in the toner and solves the problems of the unstable charge-mass ratio of toner, unstable distribution of charge-mass ratio of toner and bad printing effect caused by the out-leakage of the colorant and the wax in the preparation process of the chemical toner for a long time. The produced toner has advantages of good developing density and resolution, large amount of charge, narrow distribution of charge amount, low gray background and waste powder rates in printing and lower consumption.

DETAILED DESCRIPTION OF THE EMBODIMENTS

Preparation Example A1 of Emulsion with Colorant

Add 100 g carbon black into a high-speed dispersion machine and then add 500 g N, N-dimethylformamide and disperse them in the high-speed dispersion machine for 15 min; then add 20 g chloroacetyl chloride; after 1 h reaction, filter, wash and dry the product and the modified carbon black is produced; successively add 100 g modified colorant, 1000 g methanol, 650 g styrene, 200 g butyl acylate, 50 g tert-butyl acrylate, 10 g cuprous bromide and 20 g N,N',N"-PMDETA into a 4 L reaction bulb and disperse them at a high speed; then degas and heat it up to 80° C. to start reaction; after 5 h, lower the temperature to less than 40° C. and slowly add the product gained into the aqueous solution of 6000 g water and 10 g sodium dodecyl benzene sulfonate (SDBS); then disperse it for 2 h at 18000 rpm and the first emulsion A1 with colorant is produced. The particle diameter of the emulsion is 205 nm.

Preparation Example A2 of Emulsion with Colorant

Add 300 g pigment blue 15:3 into a high-speed dispersion machine and then add 500 g toluene and disperse them in the high-speed dispersion machine for 15 min; then add 15 g bromoacetyl bromide; after 1 h reaction, filter, wash and dry the product and the modified blue colorant is produced; successively add 300 g modified colorant, 1000 g methanol, 550 g styrene, 100 g butyl acylate, 50 g tert-butyl acrylate, 10 g cuprous bromide and 20 g N,N',N"-PMDETA into a 4 L reaction bulb and disperse them at a high speed; then degas and heat it up to 80° C. to start reaction; after 5 h, lower the temperature to less than 40° C. and slowly add the product gained into the aqueous solution of 6000 g water and 20 g sodium dodecyl benzene sulfonate (SDBS); then disperse it for 2 h at 18000 rpm and the first emulsion A2 with colorant is produced. The particle diameter of the emulsion is 182 nm.

Preparation Example A3 of Emulsion with Colorant

Add 100 g pigment yellow PY93 into a high-speed dispersion machine and then add 500 g tetrahydrofuran and disperse them in the high-speed dispersion machine for 15 min; then add 30 g 2-bromopropionyl bromide; after 1 h reaction, filter, wash and dry the product and the modified yellow colorant is produced; successively add 100 g modified colorant, 1000 g methanol, 650 g styrene, 200 g butyl acylate, 50 g tert-butyl acrylate, 10 g cuprous bromide and 20 g 2,2'-bipyridine into a 4 L reaction bulb and disperse them at a high speed; then degas and heat it up to 80° C. to start reaction; after 5 h, lower the temperature to less than 40° C. and slowly add the product gained into the aqueous solution of 5000 g water and 12 g sodium dodecyl benzene sulfonate (SDBS); then disperse it for 2 h at 18000 rpm and the first emulsion A3 with colorant is produced. The particle diameter of the emulsion is 210 nm.

Preparation Example A4 of Emulsion with Colorant

Add 200 g pigment red 122 into a high-speed dispersion machine and then add 500 g toluene and disperse them in the high-speed dispersion machine for 15 min; then add 25 g 2-chloropropionyl chloride; after 1 h reaction, filter, wash and dry the product and the modified magenta colorant is produced; successively add 200 g modified colorant, 1000 g methanol, 600 g styrene, 150 g butyl acylate, 50 g tert-butyl acrylate, 8 g ferrous chloride and 32 g triphenylphosphine into a 4 L reaction bulb and disperse them at a high speed; then degas and heat it up to 80° C. to start reaction; after 8 h, lower the temperature to less than 40° C. and slowly add the product gained into the aqueous solution of 5000 g water and 15 g sodium dodecyl benzene sulfonate (SDBS); then disperse it for 2 h at 18000 rpm and the first emulsion A4 with colorant is produced. The particle diameter of the emulsion is 193 nm.

Preparation Example B1 of Emulsion with Wax

Add 100 g oxidized petroleum wax into a high-speed dispersion machine and then add 500 g N and N-dimethylformamide and disperse them in the high-speed dispersion machine for 15 min; then add 20 g chloroacetyl chloride; after 1 h reaction, filter, wash and dry the product and the modified oxidized petroleum wax is produced; add 100 g modified petroleum wax, 1000 g butanol, 600 g styrene, 240 g butyl acylate, 60 g tert-butyl acrylate, 10 g cuprous bromide and 20 g N,N',N"-PMDETA into a 4 L reaction bulb and disperse them at a high speed; then degas and heat it up to 80° C. to start reaction; after 5 h, lower the temperature to be lower than 40° C. and add the materials into the aqueous solution of 6000 g water and 10 g sodium dodecyl benzene sulfonate (SDBS); then disperse it for 2 h at 18000 rpm and the second emulsion B1 with oxidized petroleum wax is produced. The particle diameter of the emulsion is 212 nm.

Preparation Example B2 of Emulsion with Wax

Add 300 g PP-g-MAH into a high-speed dispersion machine and then add 500 g N and N-dimethylformamide and disperse them in the high-speed dispersion machine for 15 min; then add 40 g bromopropionyl bromide; after 1 h reaction, filter, wash and dry the product and the modified PP-g-MAH is produced; add 300 g modified petroleum wax, 1000 g methanol, 500 g styrene, 150 g butyl acylate, 50 g tert-butyl acrylate, 10 g cuprous bromide and 20 g N,N',N"-PMDETA into a 4 L reaction bulb and disperse them at a high speed; then degas and heat it up to 80° C. to start reaction; after 5 h, lower the temperature to be lower than 40° C. and add the materials into the aqueous solution of 5000 g water and 10 g sodium dodecyl benzene sulfonate (SDBS); then disperse it for 2 h at 18000 rpm and the second emulsion B2 with oxidized petroleum wax is produced. The particle diameter of the emulsion is 230 nm.

Preparation of Third Emulsion C

Dissolve 6 g sodium dodecyl sulfate in 800 g water and then add the compound of 180 g styrene, 15 g butyl acylate and 5 g butyl acylate into the solution; stir them well and then add the aqueous solution of 3 g potassium persulfate and 10 g water; heat it up to 80° C. and keep for 6 h then the emulsion is produced.

Example 1 of Preparation of Toner

Add 120 g A1 emulsion and 80 g B1 emulsion into a reactor when they are stirred at 500 rpm and then add 2 g 10% polymeric aluminum to regulate the PH of the reaction system to 3; stir it for 30 min and then heat it up to 60° C. by 30 min; slow down the stirring rate to 200 rpm; test the change of the diameter of particles; when the diameter of the agglutinated particles reaches to 7 μm, add ammonia water into the reaction system to regulate its PH to 7 and then add non-ionic surfactant X-405 into the system and speed up the stirring rate to 400 rpm; heat it up to 95° C. and spheroidize it; when the sphericity reaches to over 0.96 (tested by FPIA-3000), cool down, filter by centrifuge, wash by water, heat, decompress and dry it. Add additive into the dried particles and toner is produced. The produced toner is called toner T1.

Example 2 of Preparation of Toner

Add 80 g A1 emulsion and 120 g B1 emulsion into a reactor when they are stirred at 500 rpm and then add 2 g 10% polymeric aluminum to regulate the PH of the reaction system to 2.6; stir it for 30 min and then heat it up to 60° C. by 30 min;

slow down the stirring rate to 200 rpm; test the change of the diameter of particles; when the diameter of the agglutinated particles reaches to 7 μm, add ammonia water into the reaction system to regulate its PH to 7.1 and then add non-ionic surfactant X-405 into the system and speed up the stirring rate to 400 rpm; heat it up to 95° C. and spheroidize it; when the sphericity reaches to over 0.96 (tested by FPIA-3000), cool down, filter by centrifuge, wash by water, heat, decompress and dry it. Add additive into the dried particles and toner is produced. The produced toner is called toner T2.

Example 3 of Preparation of Toner

Add 100 g A1 emulsion, 80 g B1 emulsion and 20 g C emulsion into a reactor when they are stirred at 500 rpm and then add 2.5 g 10% aluminum sulfate to regulate the PH of the reaction system to 3; stir it for 30 min and then heat it up to 60° C. by 30 min; slow down the stirring rate to 200 rpm; test the change of the diameter of particles; when the diameter of the agglutinated particles reaches to 7 μm, add ammonia water into the reaction system to regulate its PH to 7 and then add non-ionic surfactant X-405 into the system and speed up the stirring rate to 400 rpm; heat it up to 95° C. and spheroidize it; when the sphericity reaches to over 0.96 (tested by FPIA-3000), cool down, filter by centrifuge, wash by water, heat, decompress and dry it. Add additive into the dried particles and toner is produced. The produced toner is called toner T3.

Example 4 of Preparation of Toner

Add 30 g A2 emulsion and 270 g B1 emulsion into a reactor when they are stirred at 500 rpm and then add 5 g 20% magnesium sulfate to regulate the PH of the reaction system to 8.5; stir it for 30 min and then heat it up to 80° C. by 30 min; slow down the stirring rate to 200 rpm; test the change of the diameter of particles; when the diameter of the agglutinated particles reaches to 7 μm, add 200 g water into the reaction system and then add non-ionic surfactant X-405 into the system and speed up the stirring rate to 400 rpm; heat it up to 95° C. and spheroidize it; when the sphericity reaches to over 0.96 (tested by FPIA-3000), cool down, filter by centrifuge, wash by water, heat, decompress and dry it. Add additive into the dried particles and toner is produced. The produced toner is called toner T4.

Example 5 of Preparation of Toner

Add 270 g A1 emulsion and 30 g B1 emulsion into a reactor when they are stirred at 500 rpm and then add 6 g 20% magnesium chloride to regulate the PH of the reaction system to 9; stir it for 30 min and then heat it up to 80° C. by 30 min; slow down the stirring rate to 200 rpm; test the change of the diameter of particles; when the diameter of the agglutinated particles reaches to 7 μm, add 200 g water into the reaction system and then add non-ionic surfactant X-405 into the system and speed up the stirring rate to 400 rpm; heat it up to 95° C. and spheroidize it; when the sphericity reaches to over 0.96 (tested by FPIA-3000), cool down, filter by centrifuge, wash by water, heat, decompress and dry it. Add additive into the dried particles and toner is produced. The produced toner is called toner T5.

Example 6 of Preparation of Toner

Add 100 g A3 emulsion, 60 g B2 emulsion and 90 g C emulsion into a reactor when they are stirred at 500 rpm and then add 5 g 20% magnesium sulfate to regulate the PH of the reaction system to 8; stir it for 30 min and then heat it up to 80° C. by 30 min; slow down the stirring rate to 200 rpm; test the change of the diameter of particles; when the diameter of the agglutinated particles reaches to 7 μm, add 200 g water into the reaction system and then add non-ionic surfactant X-405 into the system and speed up the stirring rate to 400 rpm; heat it up to 95° C. and spheroidize it; when the sphericity reaches to over 0.96 (tested by FPIA-3000), cool down, filter by centrifuge, wash by water, heat, decompress and dry it. Add additive into the dried particles and toner is produced. The produced toner is called toner T6.

Example 7 of Preparation of Toner

Add 50 g A4 emulsion, 100 g B2 emulsion and 90 g C emulsion into a reactor when they are stirred at 500 rpm and then add 5 g 20% magnesium sulfate to regulate the PH of the reaction system to 8; stir it for 30 min and then heat it up to 80° C. by 30 min; slow down the stirring rate to 200 rpm; test the change of the diameter of particles; when the diameter of the agglutinated particles reaches to 7 μm, add 200 g water into the reaction system and then add non-ionic surfactant X-405 into the system and speed up the stirring rate to 400 rpm; heat it up to 95° C. and spheroidize it; when the sphericity reaches to over 0.96 (tested by FPIA-3000), cool down, filter by centrifuge, wash by water, heat, decompress and dry it. Add additive into the dried particles and toner is produced. The produced toner is called toner T7.

Test toner T1-T7 of the examples on the real machine. The result is as follow (see Table 1):

TABLE 1

| Properties | Particle size (μm) | Sphe-ricity | Development density | Bottom ash |
|---|---|---|---|---|
| Toner T1 | 6.332 | 0.972 | 1.35 | 0.001 |
| Toner T2 | 6.541 | 0.973 | 1.34 | 0.003 |
| Toner T3 | 6.723 | 0.970 | 1.32 | 0.001 |
| Toner T4 | 7.023 | 0.980 | 1.47 | 0.002 |
| Toner T5 | 6.238 | 0.975 | 1.38 | 0.003 |
| Toner T6 | 6.814 | 0.969 | 1.41 | 0.004 |
| Toner T7 | 6.571 | 0.980 | 1.37 | 0.002 |

| Charge (μc/g) | Standard deviation of charge distribution (fc/10 μm) | Waste rate | Consumption (mg) | Resolution (line pair/mm) |
|---|---|---|---|---|
| 46.1 | 2.97 | 7% | 12.2 | 6 |
| 49.2 | 3.04 | 10% | 16.1 | 12 |
| 45.3 | 3.11 | 12% | 15.1 | 6 |
| 44.5 | 2.76 | 8% | 14.3 | 12 |
| 50.1 | 2.69 | 11% | 13.5 | 12 |
| 42.4 | 2.87 | 9% | 13.7 | 6 |
| 47.1 | 2.91 | 9% | 10.9 | 12 |

The test data and the evaluation effect of the real machine show that the toner produced by the method of the invention has advantages of good developing density, high charge-mass ratio of toner, narrow distribution of charge-mass ratio of toner, low gray background and waste powder rates in printing, lower consumption and higher resolution.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for preparing a colored toner, the method comprising the following steps:

a) providing surface-treated colorant particles as an initiating agent, wherein the surface-treated colorant particles comprise a first initiator group for atom transfer radical polymerization (ATRP); mixing the surface-treated colorant particles with a first monomer that can undergo ATRP and heating to allow the first monomer to polymerize by ATRP onto the first initiator group to produce polymer-grafted colorant particles, and then dispersing the polymer-grafted colorant particles in a first aqueous solution comprising a first surfactant to yield a first emulsion;

b) providing surface-treated wax particles as an initiating agent, wherein the surface-treated wax particles comprise a second initiator group for ATRP;

mixing the surface-treated wax particles with a second monomer that can undergo ATRP and heating to allow the second monomer to polymerize by ATRP onto the second initiator group to produce polymer-grafted wax particles, and then dispersing the polymer-grafted wax particles in a second aqueous solution comprising a second surfactant to yield a second emulsion; and c) agglutinating the first emulsion and the second emulsion to obtain a colored toner.

2. The method of claim 1, wherein a third emulsion is added during the agglutinating, and the third emulsion is a polymer emulsion comprising polymers produced from emulsion polymerization of the first monomer or the second monomer.

3. The method of claim 2, wherein the surface-treated colorant particles are obtained by: 1) adding colorant particles into a first solvent, dispersing the colorant particles while dropwise adding a first modifier for surface modification, and washing, filtering, and drying to obtain the surface-treated colorant particles; and the surface-treated wax particles are obtained by: 1) adding wax particles into a second solvent, dispersing the wax particles while dropwise adding a second modifier for surface modification, and washing, filtering, and drying to obtain the surface-treated wax particles.

4. The method of claim 3, wherein the first solvent and the second solvent are toluene, dichloromethane, tetrahydrofuran, or a mixture thereof, and the first modifier and the second modifier are 2-chloropropionyl chloride, 2-bromopropionyl bromide, a derivative of 2-chloropropionyl chloride, or a derivative of 2-bromopropionyl bromide.

5. The method of claim 2, wherein during the agglutination, the first emulsion accounts for 10% to 60%, the second emulsion accounts for 10% to 60% and the third emulsion accounts for 0% to 80%, and the total weight percent is 100%.

6. The method of claim 2, wherein the first monomer and the second monomer are styrene, α-methyl styrene, ethyl acrylate, n-butyl acrylate, isobutyl acrylate, tert-butyl acrylate, n-hexyl acrylate, 2-ethylhexyl acrylate, dodecyl acrylate, methyl methacrylate, ethyl methacrylate, n-butyl methacrylate, isobutyl methacrylate, tert-butyl methacrylate, n-hexyl methacrylate, 1,3-butadiene, 1,2-butadiene, or a mixture thereof.

7. The method of claim 1, wherein in the colored toner, a mass percent of the content of the colorant particles is 3% to 10% and a mass percent of the content of the wax is 3% to 15%.

8. The method of claim 7, wherein the surface-treated colorant particles are obtained by: 1) adding colorant particles into a first solvent, dispersing the colorant particles while dropwise adding a first modifier for surface modification, and washing, filtering, and drying to obtain the surface-treated colorant particles; and the surface-treated wax particles are obtained by: 1) adding wax particles into a second solvent, dispersing the wax particles while dropwise adding the a second modifier for surface modification, and washing, filtering, and drying to obtain the surface-treated wax particles.

9. The method of claim 8, wherein the first solvent and the second solvent are toluene, dichloromethane, tetrahydrofuran, or a mixture thereof, and the first modifier and the second modifier are 2-chloropropionyl chloride, 2-bromopropionyl bromide, a derivative of 2-chloropropionyl chloride, or a derivative of 2-bromopropionyl bromide.

10. The method of claim 8, wherein particle diameters of the first emulsion and the second emulsion are both between 100 nm and 500 nm.

11. The method of claim 1, wherein the surface-treated colorant particles are obtained by: 1) adding colorant particles into a first solvent, dispersing the colorant particles while dropwise adding a first modifier for surface modification, and washing, filtering, and drying to obtain the surface-treated colorant particles; and the surface-treated wax particles are obtained by: 1) adding wax particles into a second solvent, dispersing the wax particles while dropwise adding a second modifier for surface modification, and washing, filtering, and drying to obtain the surface-treated wax particles.

12. The method of claim 11, wherein the first solvent and the second solvent are toluene, dichloromethane, tetrahydrofuran, or a mixture thereof, and the first modifier and the second modifier are 2-chloropropionyl chloride, 2-bromopropionyl bromide a derivative of 2-chloropropionyl chloride, or a derivative of 2-bromopropionyl bromide.

13. The method of claim 1, wherein particle diameters of the first emulsion and the second emulsion are both between 100 nm and 500 nm.

14. The method of claim 1, wherein during the agglutination, a flocculant is added.

15. The method of claim 14, wherein the flocculant is selected from sodium chloride, sodium sulfate, sodium nitrate, magnesium chloride, magnesium sulfate, magnesium nitrate, aluminum sulfate, polymeric chloride, sodium hexametaphosphate, and sodium phosphate.

16. A colored toner, being prepared according to a method of claim 1.

17. The method of claim 1, wherein the first initiator group and the second initiator group are 2-chloropropionyl or 2-bromopropionyl;

the first monomer and the second monomer are styrene, α-methyl styrene, ethyl acrylate, n-butyl acrylate, isobutyl acrylate, tert-butyl acrylate, n-hexyl acrylate, 2-ethylhexyl acrylate, dodecyl acrylate, methyl methacrylate, ethyl methacrylate, n-butyl methacrylate, isobutyl methacrylate, tert-butyl methacrylate, n-hexyl methacrylate, 1,3-butadiene, 1,2-butadiene, or a mixture thereof; and the first surfactant and the second surfactant are an anionic surfactant, a cationic surfactant, a non-ionic surfactant, or a mixture thereof.

18. A method for preparing a colored toner, the method comprising:

a) dispersing colorant particles in a first solvent and dropwise adding a first modifier for surface modification to obtain surface-treated colorant particles, wherein the first solvent is toluene, dichloromethane, tetrahydrofuran, or a mixture thereof, the first modifier is 2-chloropropionyl chloride or 2-bromopropionyl bromide, and the surface-treated colorant particles comprise a first initiator group for atom transfer radical polymerization (ATRP), and the first initiator group is 2-chloropropionyl or 2-bromopropionyl;

b) mixing the surface-treated colorant particles from a) with a first monomer and heating at a temperature of 80° C. to allow the first monomer to polymerize by ATRP onto the first initiator group to produce polymer-grafted colorant particles, wherein the first monomer is styrene, α-methyl styrene, ethyl acrylate, n-butyl acrylate, isobutyl acrylate, tert-butyl acrylate, n-hexyl acrylate, 2-ethylhexyl acrylate, dodecyl acrylate, methyl methacrylate, ethyl methacrylate, n-butyl methacrylate, isobutyl methacrylate, tert-butyl methacrylate, n-hexyl methacrylate, 1,3-butadiene, 1,2-butadiene, or a mixture thereof;

c) dispersing the polymer-grafted colorant particles from b) in a first aqueous solution comprising a first surfactant to yield a first emulsion, wherein the first surfactant is an anionic surfactant, a cationic surfactant, a non-ionic surfactant, or a mixture thereof;

d) dispersing wax particles in a second solvent and dropwise adding a second modifier for surface modification to obtain surface-treated wax particles, wherein the second solvent is toluene, dichloromethane, tetrahydrofuran, or a mixture thereof, the second modifier is 2-chloropropionyl chloride or 2-bromopropionyl bromide, and the surface-treated wax particles comprise a second initiator group for ATRP, and the second initiator group is 2-chloropropionyl or 2-bromopropionyl;

e) mixing the surface-treated wax particles from d) with a second monomer and heating at a temperature of 80° C. to allow the second monomer to polymerize by ATRP onto the second initiator group to produce polymer-grafted wax particles, wherein the second monomer is styrene, α-methyl styrene, ethyl acrylate, n-butyl acrylate, isobutyl acrylate, tert-butyl acrylate, n-hexyl acrylate, 2-ethylhexyl acrylate, dodecyl acrylate, methyl methacrylate, ethyl methacrylate, n-butyl methacrylate, isobutyl methacrylate, tert-butyl methacrylate, n-hexyl methacrylate, 1,3-butadiene, 1,2-butadiene, or a mixture thereof;

f) dispersing the polymer-grafted wax particles from e) in a second aqueous solution comprising a second surfactant to yield a second emulsion, wherein the second surfactant is an anionic surfactant, a cationic surfactant, a non-ionic surfactant, or a mixture thereof; and g) intermixing the first emulsion from c) with the second emulsion from f) and stirring to allow the polymer-grafted colorant particles and the polymer-grafted wax particles to agglutinate to obtain a colored toner.

* * * * *